United States Patent [19]

Crowley

[11] Patent Number: 4,479,337

[45] Date of Patent: Oct. 30, 1984

[54] REFRACTORY ANCHOR

[75] Inventor: Michael S. Crowley, Chicago Heights, Ill.

[73] Assignee: Standard Oil Company (Indiana), Chicago, Ill.

[21] Appl. No.: 331,181

[22] Filed: Dec. 16, 1981

Related U.S. Application Data

[63] Continuation of Ser. No. 140,174, Apr. 14, 1980, abandoned.

[51] Int. Cl.[3] ..... E04B 1/24; E04C 2/04

[52] U.S. Cl. ..... 52/378; 52/334; 52/443

[58] Field of Search ..... 52/379, 378, 249, 600, 52/443; 138/153; 110/246, 336; 432/119, 118

[56] References Cited

U.S. PATENT DOCUMENTS

| | | | |
|---|---|---|---|
| 1,624,386 | 4/1927 | Betts | 52/600 |
| 2,340,176 | 1/1944 | Cueni | 52/234 |
| 2,479,476 | 8/1949 | Cueni | 52/334 |
| 3,076,481 | 2/1963 | Wygant | 52/378 |
| 3,177,619 | 4/1965 | Benjamin | 52/334 |
| 3,424,239 | 1/1969 | Coudray | 52/378 |
| 3,449,084 | 6/1969 | Smoot | 52/249 |
| 3,564,799 | 2/1971 | Hanson | 52/334 |
| 3,587,198 | 6/1971 | Hensel | 52/378 |

*Primary Examiner*—John E. Murtagh

*Attorney, Agent, or Firm*—Lansing M. Hinrichs; William T. McClain; William H. Magidson

[57] ABSTRACT

A metal refractory anchor adapted for installation by welding to a metal surface together with a number of other like anchors to provide anchorage protection from erosion for a monolithic refractory applied to the surface, said anchor being formed from a metal strip having its width substantially equal to the thickness of the refractory to be applied to said surface and its length several times its width. The anchor has cut away portions at each end whereby there is provided at each end an extending arm, the extending arms together with the intermediate portion of said anchor providing an erosion resistant barrier for the protection of the refractory and the cut away portions adjacent said arms providing room for said refractory to be deposited between said arms and said surface.

5 Claims, 5 Drawing Figures

REFRACTORY ANCHOR

This is a continuation division, of application Ser. No. 140,174, filed Apr. 14, 1980, now abandoned.

BACKGROUND OF THE INVENTION

1. Field of the Invention

This invention relates to the installation of monolithic refractory linings in process vessels or equipment such as reactors, conduits, furnaces, incinerators and the like and more particularly to an improved anchor which is inexpensive to form and install which not only secures the refractory lining in place but also provides protection of the refractory from mechanical erosion.

2. Description of the Prior Art

Refractory liners have been used for many years in process vessels, reactors, conduits, furnaces and the like to provide thermal insulation and in environments such as fluidized catalytic reactors or regenerators or stacks to provide resistance to abrasion or erosion. Thus such liners can serve not only to thermally insulate a shell or other surface but also to prolong its service life by shielding it from erosion by abrasion. In fluid catalytic cracking units for petroleum hydrocarbons quite high fluid velocities which may be on the order of 50 to 70 ft/second occur and the abrasive effect of entrained cracking catalyst is very pronounced. Moreover, high temperatures are involved, for example in the regenerator the temperature of gases exiting through the cyclones may be on the order of 1250°-1350° F. and in the reactor the temperature may be 800°-900° F. Accordingly, the usual practice has been to line all vessels, conduits and cyclone separators through which fluid with entrained catalyst flows with refractory liner to prevent erosion of the metal surfaces and to provide thermal insulation. To retain the refractory which may be a refractory cement, a concrete cement-aggregate mixture, a reinforced cement or concrete, various anchoring arrangements have been employed. U.S. Pat. No. 3,076,481 to Wygant, which is hereby incorporated by reference, contains a description of certain of the problems involved in anchoring refractory concrete linings and of a particular anchorage arrangement.

Heretofore, a preferred anchorage arrangement which also provided erosion protection was the use of hexagonal steel grating which was welded to the vessel or conduit wall. The grating had the same depth as the refractory liner to be applied and the refractory was deposited in the hexagonal spaces defined by the grating. Thus the grating provided the desired erosion resistance for the refractory by projecting to the exposed surface of the refractory. The disadvantages of hexagonal grating are its relatively high cost, lack of flexibility which makes it difficult or impossible to apply to curved surfaces, its tendency to separate from the vessel or conduit wall over relatively large areas when welds fail and its unsuitability for use with fiber reinforced refractories or with refractory concretes containing coarse aggregate particles.

In situations where hexagonal grating is not suitable weldable studs such as those described in U.S. Pat. No. 3,657,851 to Chambers et al. and U.S. Pat. No. 3,336,712 to Bartley have been proposed. Such studs are suitable for use with fiber reinforced refractory or with refractory concrete but do not provide erosion protection for the refractory.

One object of this invention is to provide an inexpensive anchoring arrangement suitable for use with fiber or needle reinforced refractory cement or concrete and which provides protection of the refractory from erosion.

A second object is to provide an anchor arrangement which may be utilized on relatively highly curved surfaces such as within cyclones or conduits such as riser reactors or transfer lines.

A further object is to provide an anchor which is appropriately shaped that it may be installed in an array with other like anchors to provide erosion protection from streams in any direction.

Other objects and advantages of this invention will become apparent to one skilled in the art based upon the ensuing description.

SUMMARY OF THE INVENTION

A metal anchor adapted for installation by welding to a metal surface together with a number of other like anchors to provide anchorage for a monolithic refractory applied to said surface, the anchor being formed from a metal strip having its width substantially equal to the thickness of the refractory to be applied to said surface and its length several times its width and having cut away portions at each end on the side to be welded to the surface to be protected whereby there is provided at each end of said anchor an extending arm, the extending arms together with the intermediate portion of said anchor providing an erosion resistant barrier for the protection of the refractory and the cut away portions adjacent the arms providing room for said refractory to be deposited between said arms and said surface. In a preferred embodiment the extended arms are curved in opposite directions away from the plane of the intermediate portion, the shape of the anchor approximating the shape of the letter S.

The invention also involves the structure which results when a plurality of the above described anchors are installed in the preferred arrangement upon a wall to be protected with a refractory, namely, a structure comprised of a metal surface and a plurality of metal anchors welded to said surface in spaced relationship to each other for providing anchorage for a monolithic refractory to be applied to said surface, each of said anchors being formed from a metal strip having its width substantially equal to the thickness of the refractory to be applied to the surface and its length several times its width and having cut away portions at each end on the side welded to said surface whereby there is provided at each end of the anchor an extending arm, said extending arms together with the intermediate portion of said anchor providing an erosion resistant barrier for the protection of the refractory and the cut away portions adjacent said arms providing room for said refractory to be deposited between said arms and said surface. In a preferred embodiment of the structure the metal anchors are bent to the approximate shape of the letter S and are arranged in rows on said surface with the anchors in alternate rows being disposed at substantially different angles.

DETAILED DESCRIPTION OF THE INVENTION

Figure 1:
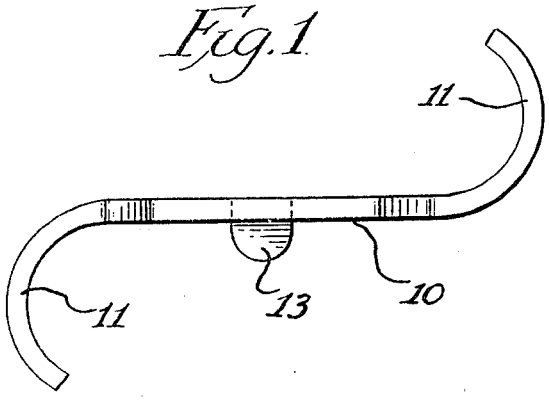
FIG. 1 is view of the preferred form of the anchor of this invention from the side adapted to be welded to the surface to which the refractory is to be applied.
Figure 2:
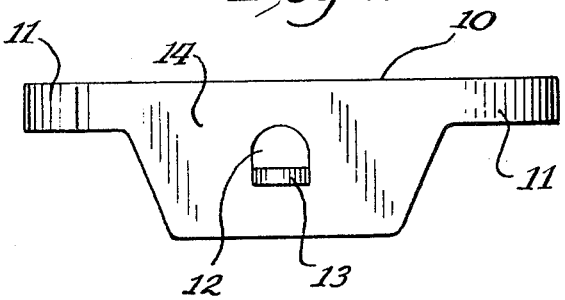
FIG. 2 is a side view of the anchor.

The preferred embodiment of the anchor 10 is shown in FIGS. 1 and 2 of the drawings. The anchor 10 is preferably stamped from a strip of metal having its width equivalent to the thickness of the refractory liner to be applied. By stamping or otherwise cutting alternate anchors with the extended arms 11 on opposite sides of the strip considerable metal can be saved. This result can be achieved by rotating the strip about its long axis 180 degrees each time an anchor is stamped. At the time of stamping a hole 12 and protecting tab 13 are formed in the central intermediate portion 14 of the strip. If desired no holes or a plurality of holes can be provided and the holes optionally can be with or without tabs. As will be described the holes and tabs perform useful functions in the application of the refractory and in most cases their incorporation in the anchor will be desirable. The arms 11 of the anchor 10 may be bent to the curvature illustrated in FIG. 1 at the time of stamping or cutting of the anchors or in a subsequent operation depending on the availability of appropriate equipment.

The size of the anchors can be varied according to the surface to be refractory lined, the thickness and type of refractory to be employed. A convenient anchor for securing a refractory one inch thick is made from 16 gauge Type 304 stainless steel strip one inch wide. The length of the anchor prior to bending the arms 11 is approximately six inches and each arm is bent to a one half inch radius. The width of the arms 11 can be $\frac{1}{4}$ to $\frac{1}{2}$ an inch, as desired. The spacing of the anchors when they are welded to the surface of be refractory coated is a function of the size of the anchors. For the above described size anchor the anchors should be spaced apart over the surface upon three inch centers. Thus it will be seen that spacing should generally be on centers spaced apart approximately one half the unbent length of the anchor. Thicker linings may have anchor spacings of 2 to 3 times the thickness, i.e. the anchor height.

Figure 3:
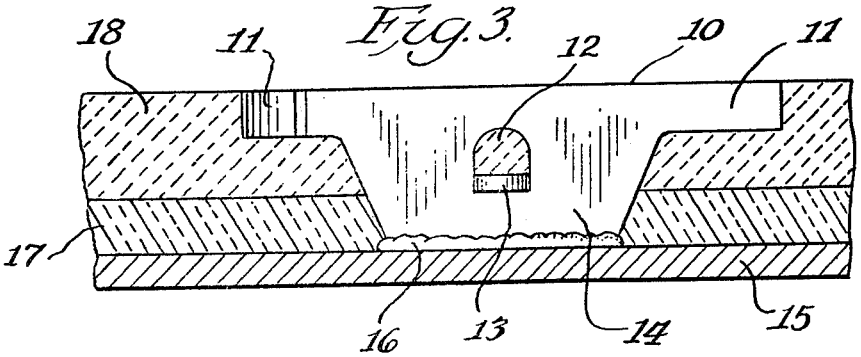
FIG. 3 is sectional view showing the anchor welded to the surface with the refractory in place.

In FIG. 3 the anchor 10 is shown welded to a surface 15 with the weld being indicated at 16. A similar weld can be utilized on the back side of the anchor. Two layers of refractory 17 and 18 are shown. The layer 17 next to the surface 15 is preferably of a refractory material having a high insulating value and the other layer 18 has a higher resistance to abrasion and erosion. Either or both of these layers can be reinforced by fibers (sometimes referred to as needles) which are preferably formed of stainless steel. Typically the fibers will be approximately $\frac{3}{4}$ to $1\frac{1}{2}$ inches in length and about 30 mil (0.030 inches) in diameter. The quantity of fibers usually employed is between about 2 and 0% by weight of the refractory on a dry basis.

In cases where it is desired to utilize a refractory concrete the aggregate can be expanded shale or vermiculite in the layer 17 having high insulating value and tabular alumina in the layer 18 having high resistance to abrasion. In such cases the projecting tabs 13 (or holes 12) can be used as very convenient indicators as to the desired thickness of the insulating layer 17. This ability to conveniently measure the thickness of the applied layer is particularly useful when very thick (up to about five inch) layers of total refractory are involved.

Figure 4:
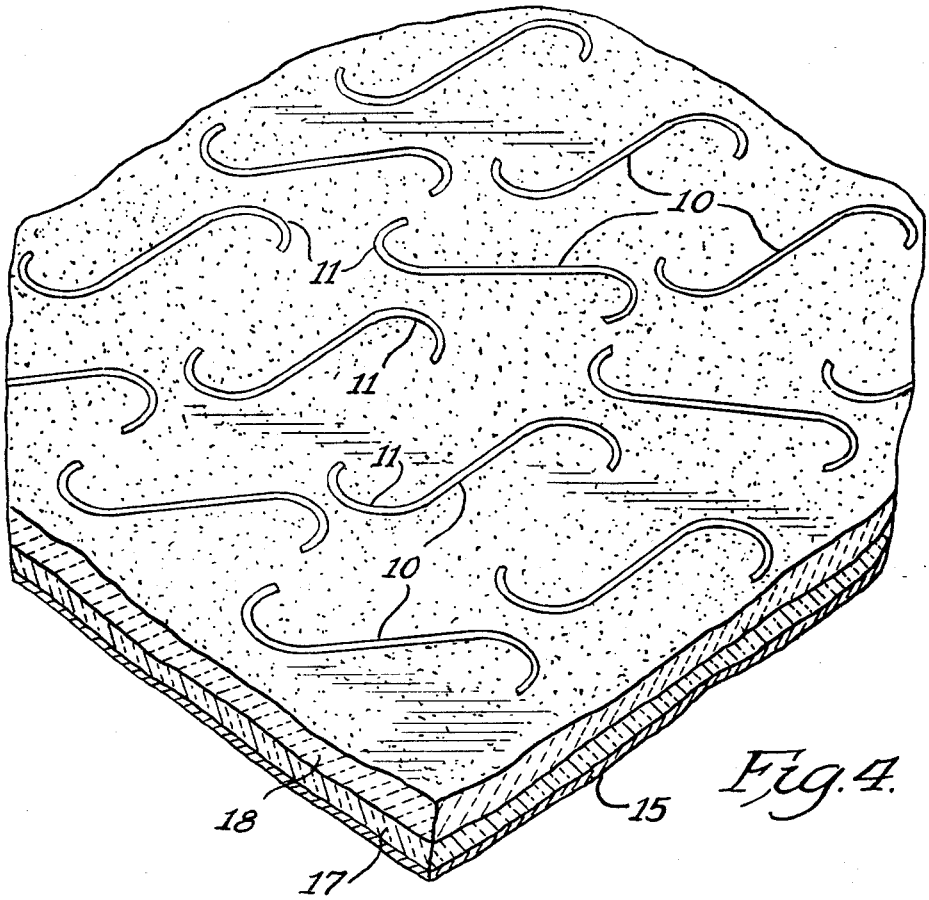
FIG. 4 is an isometric view showing the preferred array of the anchors attached to a surface with the refractory in place.

In FIG. 4 the preferred composite structure is illustrated. Initially the individual anchors 10 are affixed to the surface 15 to be protected by the refractory. As shown alternate rows of the anchors are disposed at substantially different angles to each other and because of the curving arms 11 an effective grid of metal is provided over the surface for preventing erosion. The preferred angular difference between the anchors of adjacent rows is about 45° or somewhere between about 30° and about 60° for achieving maximum erosion protection with a minimum number of anchors.

To effect attachment of the anchors they can be held in the desired position by means of a small bar having a slot in one end to receive the intermediate portion 14 of the anchor and welded to the surface 15 by forming the welding bead 16 on one or both sides. When the weld is completed the bar is pulled free for use to hold the next anchor. Alternatively, multiple tack welding or brazing, if appropriate to the metals involved, may be employed. When the anchors are all attached, the layer or layers of refractory cement, refractory concrete or fiber reinforced refractory can be applied utilizing conventional procedures such as depositing and trowelling or pneumatic application such as the Gunnite procedure.

Suitable refractories are the hydraulic calcium aluminate cements and the high alumina phosphate bonded materials which are heat setting and have superior erosion resistance. Once the refractory layer or layers have been applied and cured they are very effectively held in place by the anchors 10 of this invention, for the refractory is held against the surface 15 by the arms 11 and the tabs 13 and is continuous through the hole 12. The fact that the anchors 10 are not interconnected and have relative flexibility in their structure permits thermal expansion and contraction to occur on a localized basis. Moreover, the protective blocking effected by the anchors prevents abrasive erosion especially by streams of particulates such as fluidized catalyst which move transverse to the surface of the refractory. In contrast the use of hexagonal grating can provide erosion protection but has relatively little holding power to secure the refractory to the surface which is being protected. Moreover, when such gratings separate from the surface large sections are likely to pull loose from the surface. With the anchors of this invention any failures tend to be localized and may not necessitate shut down of the process unit.

Figure 5:
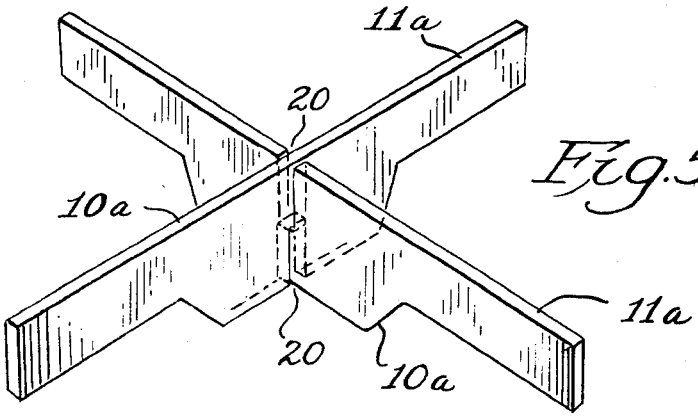
FIG. 5 is an isometric view showing another embodiment of the anchor of this invention.

Another feature of the anchors of this invention is that the array selected may be varied to suit known flow conditions. For example within cyclones where it is known that the flow pattern will be circular or helical within the barrel the anchors can be disposed with their long dimensions parallel to the axis of the barrel and thus transverse to the flow pattern. In such cases it is frequently preferable not to curve the ends of the anchors so as to obtain maximum blockage against erosion. In FIG. 5 another embodiment **10*a* of the anchor of this invention having noncurving ends 11*a* is shown. In this embodiment a pair of anchor members are appropriately slotted as shown at 20 so as to be interlockable in the form of a cross. Assembled in this manner the pair of anchors 10*a* can be welded to a surface (not shown) to be protected in the same manner as is the anchor shown in FIG. 3. The anchors 10*a* shown in FIG. 5 may be readily arrayed upon a surface with the arms 11***a* of adjacent assemblies lying in non-touching but overlapping relationship to obtain a very high degree of protection from erosion similar to that obtainable with hexagonal grating but without the disadvantages of continuous gratings.

The anchors of this invention are particularly useful in effecting repairs or patches in existing units for only affected areas need be patched and the repair consists merely of stripping away damaged refractory to have access to the vessel or conduit surface, welding anchors to the thus exposed surface, and redepositing refractory.

Other variations and modifications of the above described invention will present themselves to those familiar with the art and may be made within the spirit of the invention whose scope is defined by the following claims.

I claim:

1. A composite structure comprised of a metal surface, a monolithic refractory for providing thermal protection to said surface, and a plurality of metal anchors welded to said surface in spaced apart non-touching relationship to each other for providing both erosion protection and anchorage for said monolithic refractory applied to said surface, each of said anchors being formed from a metal strip having its width substantially equal to the thickness of the applied refractory whereby the anchors extend to the exposed surface of the refractory and the length of each anchor being several times its width and each anchor having cut away portions at each end on the side welded to said metal surface whereby there is provided at each end of said anchor an extending arm, said extending arms being bent in opposite directions to the approximate shape of the letter S and together with the intermediate portion of said anchor providing an erosion resistant barrier for the protection of said refractory and the cut away portions adjacent said arms providing room for said refractory to be deposited between said arms and said surface securely anchoring the refractory to the metal surface.

2. A structure comprising a metal surface, a refractory, and a plurality of metal anchors welded to the surface in spaced relationship to each other for providing both erosion protection and anchorage for the refractory to the metal surface, each of the anchors being formed from a metal strip having its width substantially equal to the thickness of the refractory applied to the surface and its length at least twice its width and having cut away portions at each end of the side welded to the surface whereby there is provided at each end of the anchor an extending arm, the extending arms together with the intermediate portion of the anchor extending to the exposed surface of the refractory thereby providing an erosion-resistant barrier for the protection of the refractory and the cut away portions adjacent the arms providing room for the refractory to be deposited between the arms and the metal surface, wherein the extending arms on each of the anchors are bent in opposite directions away from the plane of the intermediate portion.

3. A structure according to claim 2 provided with a metal fiber reinforced refractory lining.

4. A structure according to claim 2, wherein the extending arms are bent on curves, the shape of the anchors approximating the shape of the letter S.

5. A structure according to claim 4, wherein the metal anchors are arranged in rows on the surface with the anchors in alternate rows being disposed at angles between 30° and 60°.

* * * * *

UNITED STATES PATENT OFFICE
CERTIFICATE OF CORRECTION

Patent No. 4,479,337 Dated October 30, 1984

Inventor(s) Michael S. Crowley

It is certified that error appears in the above-identified patent and that said Letters Patent are hereby corrected as shown below:

| Patent Column | Line | |
|---|---|---|
| 3 | 1 | After "is" Add --a-- |
| 3 | 20 | reads "protecting" and should read --projecting-- |
| 3 | 61 | reads "0" and should read --6-- |

Signed and Sealed this

*First* Day of *October 1985*

[SEAL]

*Attest:*

DONALD J. QUIGG

*Attesting Officer*

*Commissioner of Patents and Trademarks—Designate*